US008839964B2

(12) United States Patent
Hawkins

(10) Patent No.: US 8,839,964 B2
(45) Date of Patent: Sep. 23, 2014

(54) BOW AND RIBBON DISPLAY FIXTURE

(71) Applicant: Target Brands, Inc., Minneapolis, MN (US)

(72) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/751,784

(22) Filed: Jan. 28, 2013

(65) Prior Publication Data

US 2014/0209551 A1 Jul. 31, 2014

(51) Int. Cl.
*A47F 5/00* (2006.01)
*A47F 5/08* (2006.01)
*A47B 96/02* (2006.01)

(52) U.S. Cl.
CPC ..... *A47F 5/0018* (2013.01); *A47B 96/027* (2013.01); *A47F 5/0807* (2013.01)
USPC ..... 211/87.01; 211/135; 211/59.1

(58) Field of Classification Search
CPC ..... A47F 5/0807; A47F 5/08; A47F 5/0815; A47F 5/0884; A47F 5/0043; A47F 5/0068; A47F 5/00; A47F 5/0018; A47F 5/10; A47F 5/11; A47F 5/112; A47F 5/16; A47F 7/00; A47B 96/02; A47B 96/06; A47B 96/027; A47B 96/028; A47B 96/00; A47B 47/00; A47B 47/02; A47B 47/021; A47B 47/022
USPC ..... 211/90.04, 90.01, 106.01, 134, 57.1, 211/59.1, 72, 73, 90.02, 135, 86.01, 87.01
See application file for complete search history.

(56) References Cited

U.S. PATENT DOCUMENTS

| | | | | | |
|---|---|---|---|---|---|
| 800,032 | A | * | 9/1905 | Turner | 211/90.04 |
| 2,097,553 | A | | 11/1937 | Gruenberg | |
| 3,101,681 | A | * | 8/1963 | Streater | 108/28 |
| 3,193,108 | A | | 7/1965 | Johnson | |
| 3,346,124 | A | * | 10/1967 | Sobel | 211/193 |
| 3,576,259 | A | * | 4/1971 | Leath | 211/149 |
| 3,830,374 | A | * | 8/1974 | Kassimir | 211/1 |
| 3,910,412 | A | | 10/1975 | Vargo | |
| 4,530,548 | A | * | 7/1985 | Spamer et al. | 312/45 |
| 4,687,094 | A | | 8/1987 | Allsop et al. | |
| D296,283 | S | | 6/1988 | Hardy | |

(Continued)

OTHER PUBLICATIONS

Office Action from Canadian Patent Application No. 2,810,506, mailed Aug. 19, 2013 (2 pages).

(Continued)

*Primary Examiner* — Jennifer E Novosad
(74) *Attorney, Agent, or Firm* — Griffiths & Seaton PLLC; JoAnn M. Seaton

(57) ABSTRACT

A display fixture includes a substantially vertical backer mounted to a wall of a gondola and a shelf unit mounted to the backer and being centrally located on the backer. The shelf unit includes a substantially vertical back wall, a pair of side walls and a plurality of shelves extending between the pair of side walls and coupled to the back wall. Each of the plurality of shelves includes a shelf surface and a lip. The lip is substantially normal to the shelf surface and the shelf surface is at an angle relative to the back wall. The relative angle between the shelf surface and the back wall is greater than 90 degrees.

24 Claims, 11 Drawing Sheets

(56) References Cited

U.S. PATENT DOCUMENTS

| | | | | |
|---|---|---|---|---|
| 4,925,038 | A | 5/1990 | Gajewski | |
| 5,163,567 | A * | 11/1992 | Betts, Sr. | 211/75 |
| D349,202 | S | 8/1994 | Eliadis et al. | |
| 5,379,976 | A * | 1/1995 | DeGirolamo | 248/220.43 |
| 5,443,168 | A | 8/1995 | Dyment et al. | |
| 6,068,140 | A * | 5/2000 | Mangrum et al. | 211/132.1 |
| 6,557,711 | B2 | 5/2003 | Grueneberg | |
| 6,581,788 | B1 * | 6/2003 | Winig et al. | 211/90.01 |
| 6,591,995 | B1 * | 7/2003 | Grove | 211/87.01 |
| D493,309 | S | 7/2004 | Moss et al. | |
| 6,793,070 | B2 | 9/2004 | Dye | |
| 7,438,186 | B2 | 10/2008 | Markson et al. | |
| 7,546,926 | B2 | 6/2009 | Stolle et al. | |
| 7,584,854 | B2 | 9/2009 | Chandaria | |
| 7,753,218 | B2 | 7/2010 | Moss et al. | |
| 7,905,365 | B2 | 3/2011 | Virvo | |
| 8,042,700 | B1 | 10/2011 | Smalley | |
| 2006/0118502 | A1 | 6/2006 | Polvere et al. | |
| 2006/0196839 | A1 | 9/2006 | Stolle et al. | |
| 2007/0215566 | A1 | 9/2007 | Shen et al. | |
| 2008/0000858 | A1 | 1/2008 | Fenerty | |
| 2010/0006529 | A1 | 1/2010 | Groff et al. | |
| 2011/0049072 | A1 | 3/2011 | Dewhurst | |
| 2011/0180502 | A1 | 7/2011 | Clark et al. | |
| 2011/0226717 | A1 | 9/2011 | Mestres Armengol et al. | |
| 2011/0303625 | A1 | 12/2011 | Freis et al. | |

OTHER PUBLICATIONS

Office Action from Canadian Patent Application No. 2,810,506, mailed Dec. 5, 2013 (2 pages).

* cited by examiner

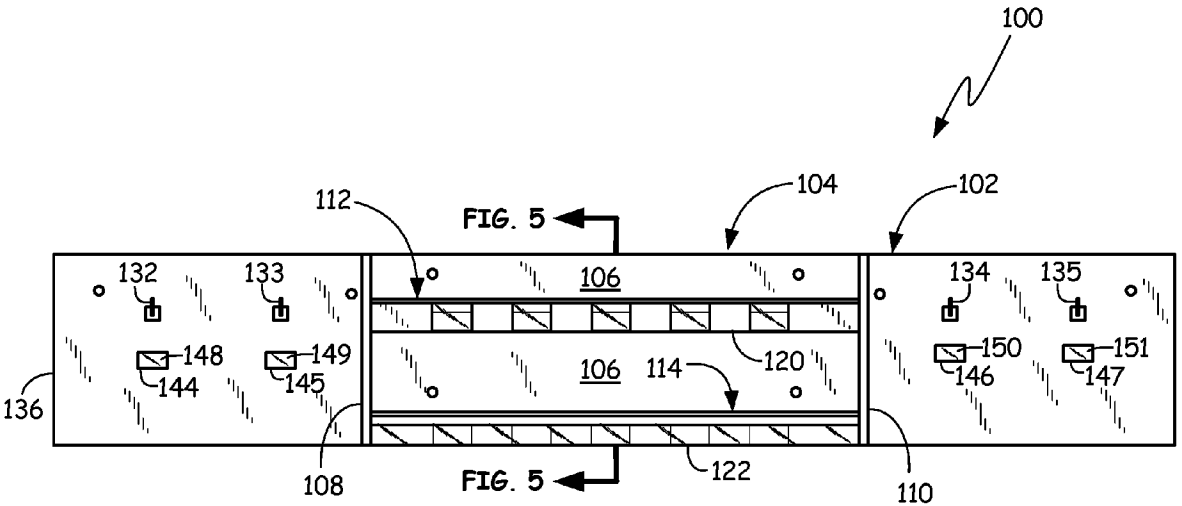
FIG. 3
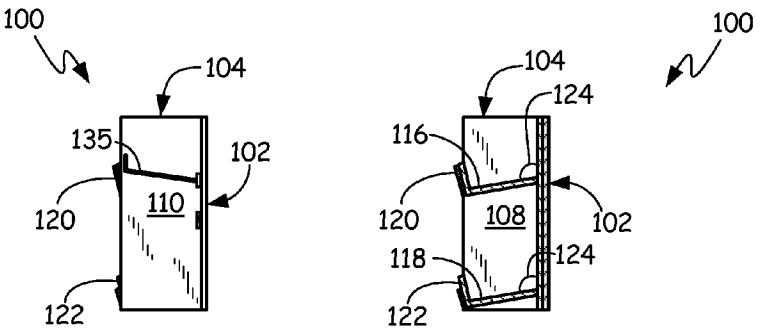
FIG. 5
FIG. 4

BOW AND RIBBON DISPLAY FIXTURE

BACKGROUND

In retail stores, seasonal merchandise is often displayed on temporary display fixtures that are supported by permanent display units, such as gondola display units. On the temporary display fixtures, seasonal merchandise must be easily accessible and visually pleasing in order to attract consumer traffic.

The discussion above is merely provided for general background information and is not intended to be used as an aid in determining the scope of the claimed subject matter.

SUMMARY

A display fixture includes a substantially vertical backer mounted to a wall of a gondola and a shelf unit mounted to the backer and being centrally located on the backer. The shelf unit includes a substantially vertical back wall, a pair of side walls and a plurality of shelves extending between the pair of side walls and coupled to the back wall. Each of the plurality of shelves includes a shelf surface and a lip. The lip is substantially normal to the shelf surface and the shelf surface is at an angle relative to the back wall. The relative angle between the shelf surface and the back wall is greater than 90 degrees.

A method of displaying merchandise includes mounting the backer to the wall of the gondola and mounting and centrally locating the shelf unit on the backer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 3 is a front view of the display fixture illustrated in FIG. 2.

FIG. 4 is a side view of the display fixture illustrated in FIG. 2, the opposite side being a minor image.

FIG. 5 is a section view of the display fixture illustrated in FIG. 2 taken along the line illustrated in FIG. 3.

DETAILED DESCRIPTION

Embodiments of display fixtures for displaying seasonal merchandise are mounted to display units, such as gondola display units, located in a retail store and are described below. A display fixture includes a backer mounted to a wall of a gondola display unit and a shelf unit having a plurality of shelves mounted to and centrally located on the backer. In one embodiment, the plurality of shelves have widths that are less than the width of the main shelf unit and the backer and hold rolls of ribbon for display. In the space along the backer that is devoid of shelves, and in one embodiment, there are a plurality of peg hooks for holding bows for display.

Figure 1:
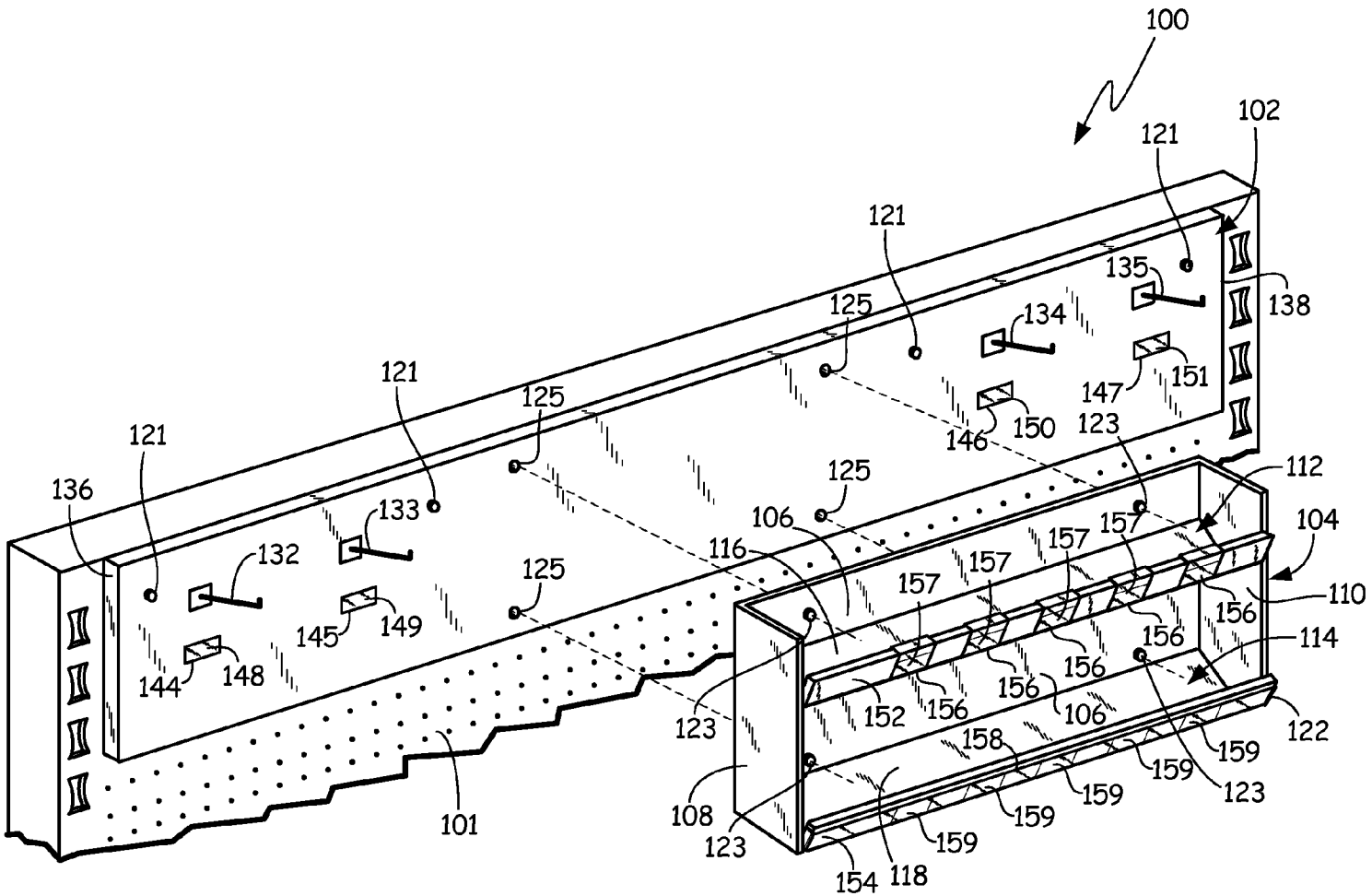
FIG. 1 is an exploded perspective view of a display fixture according to one embodiment.
Figure 2:
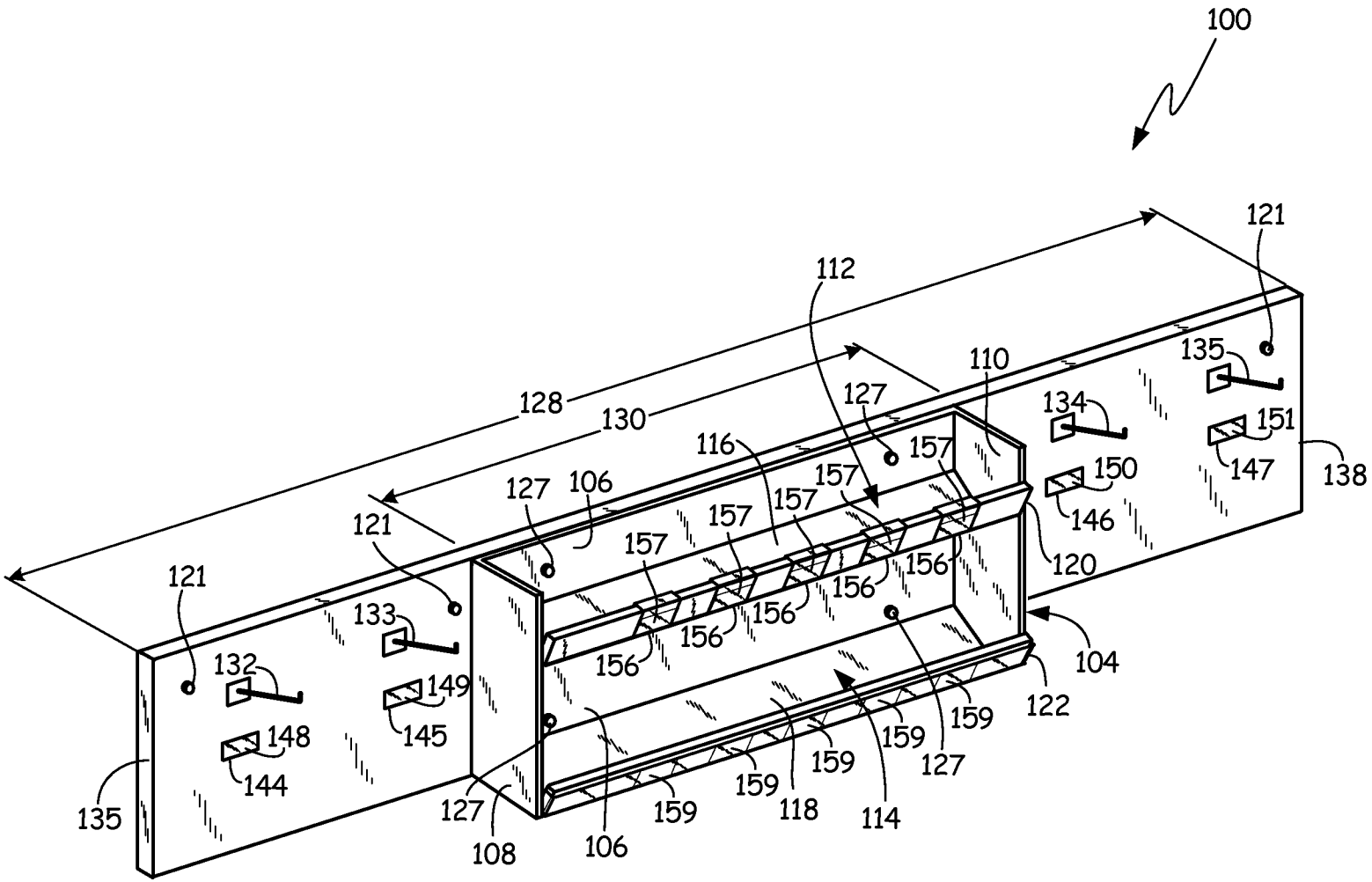
FIG. 2 is an assembled perspective view of the display fixture illustrated in FIG. 1.
Figure 6:
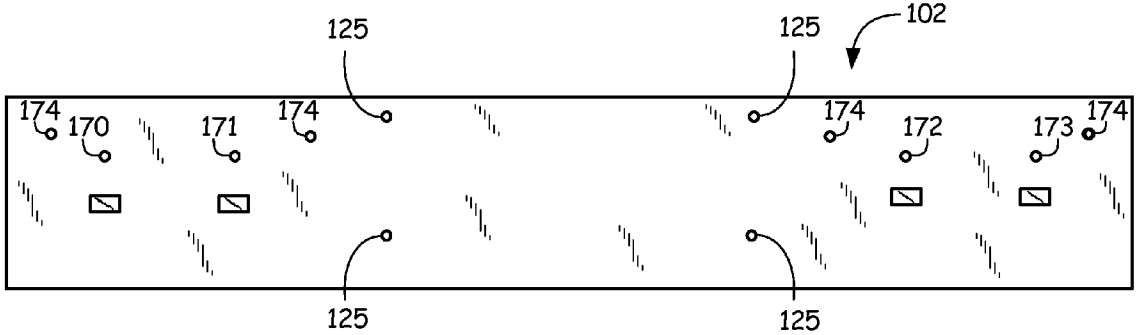
FIG. 6 is a plan view of a backer of the display fixture illustrated in FIG. 2 in a substantially planar configuration.
Figure 8:
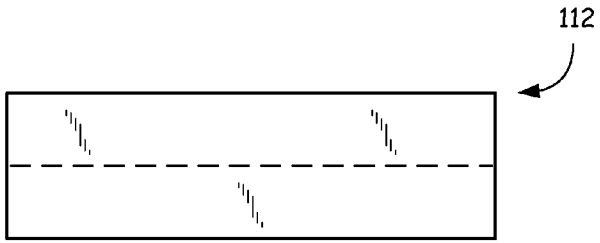
FIG. 8 is a plan view of a shelf of the shelf unit of the display fixture illustrated in FIG. 2 in a substantially planar configuration.
Figure 7:
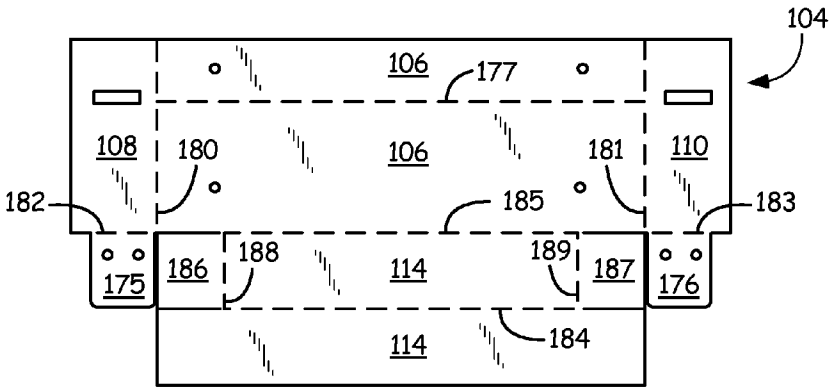
FIG. 7 is a plan view of a shelf unit of the display fixture illustrated in FIG. 2 in a substantially planar configuration.

FIG. 1 is an exploded perspective view of a display fixture 100 according to one embodiment. FIG. 2 is an assembled perspective view of the display fixture 100 illustrated in FIG. 1. FIG. 3 is a front view of the display fixture 100 illustrated in FIG. 21. FIG. 4 is a side view of the display fixture 100 illustrated in FIG. 2, the opposite side being a minor image. FIG. 5 is a section view of the display fixture 100 illustrated in FIG. 2 taken along the line indicated in FIG. 3. Each component of display fixture 100 is shipped to a retail store flat or in a substantially planar configuration and is lightweight, inexpensive, and recyclable. For example, FIG. 6 illustrates a plan view of a backer 102 in a substantially planar configuration, FIG. 7 illustrates a plan view of a shelf unit 104 in a substantially planar configuration and FIG. 8 illustrates a plan view of a shelf 112 in a substantially planar configuration. Backer 102, shelf unit 104 and shelf 112 are the three components of display fixture 100 that are shipped to a retail store flat for later assembly. In light of the substantially planar configurations, in one embodiment, display fixture 100 is a temporary display fixture that can be used during a particular shopping season and then easily deconstructed for disposal. For example, backer 102, shelf unit 104 and shelf 112 of display fixture 100 can be made of corrugated cardboard. In FIGS. 6-8, all solid lines represent edges while all dashed lines represent scores or folds.

In one embodiment, display fixture 100 holds gift decorating items, such as bows and ribbons, for display and includes backer 102 that is oriented substantially vertically and is mounted to a wall of a gondola display unit 101. The only further assembly the substantially planar configuration of backer 102 needs before being mounted to the wall of gondola display unit 101 are the insertion of peg hooks 132, 133, 134 and 135 through holes 170, 171, 172 and 173. Peg hooks 132, 133, 134 and 135 will be discussed in further detail below.

Backer 102 is mounted to the wall of gondola display unit 101 by aligning a top of backer 102 with a top of the wall of gondola display unit 101 and securing backer 102 to the wall of the gondola display unit 101 using fasteners 121 (FIG. 1). Fasteners 121 are inserted through apertures 174 (FIG. 6) in backer 102 and connect with holes in the wall of the gondola display unit 101.

Display fixture 100 also includes a shelf unit 104 mounted to and centrally located on backer 102. Further assembly is needed from the substantially planar configuration of shelf unit 104 in FIG. 7 to configure shelf unit 104 into the usable configuration illustrated in FIGS. 1-5. In particular, the substantially planar configuration of shelf unit 104 includes a back wall portion 106 (which includes an upper portion coupled to a lower portion by score or fold 177), a pair of side wall portions 108 and 110, shelf portion 114 (which includes an upper portion coupled to a lower portion by a score or fold 184 and two shelf flaps 186 and 187 coupled to the upper portion of shelf portion 114 by scores or folds 188 and 189) and a pair of tabs 175 and 176. Back wall portion 106 is coupled to side wall portions 108 and 110 by scores or folds 180 and 181, tabs 175 and 176 are coupled to side wall portions 108 and 110 by scores or folds 182 and 183 and shelf portion 114 is coupled to back wall portion 106 by a score or fold 185.

To erect shelf unit 104, shelf flaps 186 and 187 are folded up along scores 188 and 189 and side wall portions 108 and 110 are folded up. Tabs 175 and 176 are folded inwardly to align their holes with holes that are underneath shelf flaps 186 and 187. Fasteners or various pieces of hardware secure tabs 175 and 176 to the bottom of shelf portion 114. This process of connecting tabs 175 and 176 to the bottom of shelf portion 114 creates a lip 122 (FIGS. 1-5) having a double thickness of material. To complete the assembly, clips are inserted into back wall portion 106 along score or fold 177 and shelf 112, illustrated in FIG. 8, is aligned and inserted into the clips. Shelf 112 in FIG. 8 is already assembled and like shelf 114 includes a lip 120 having a double thickness of material. Fully assembled shelf unit 104 is mounted to backer 102 by aligning apertures 123 (FIG. 1) in shelf unit 104 with apertures 125 (FIG. 1) in backer 102 and inserting fasteners 127 (FIG. 2) into the aligned apertures 123 and 125.

Fully assembled shelf unit 104 includes back wall 106 that is oriented substantially vertically, the pair of side walls 108 and 110 that are oriented substantially vertically and plurality of shelves 112 and 114. Shelf unit 104 is configured to hold and display ribbon rolls and the like, while backer 102 is configured to not only receive shelf unit 104, but also receive the peg hooks for displaying other types of gift decorating items, such as bows and the like, on either side of shelf unit 104. Other types of merchandise can be displayed by display fixture 100, such as products that can be hung from a peg hook or retained on a shelf for display.

The plurality of shelves 112 and 114 of shelf unit 104 extend between the pair of side walls 108 and 110 and are coupled to back wall 106. Each shelf 112 and 114 includes a shelf surface 116 and 118 and a lip 120 and 122. Lip 120 of shelf 112 that is oriented substantially normally to shelf surface 116 and lip 122 of shelf 114 that is oriented substantially normally to shelf surface 118. Shelf surfaces 116 and 118, however, are oriented at an angle 124 and 126 relative to back wall 106, and angles 124 and 126 are substantially the same. In one embodiment, the relative angles 124 and 126 between shelf surfaces 116 and 118 and back wall 106 are greater than 90 degrees. In particular, the relative angles 124 and 126 are approximately 100 degrees. In this way, shelf surfaces 116 and 118 are oriented towards the shopper for display and each lip 120 and 122 retains the merchandise located on shelves 112 and 116 in place.

As illustrated in FIG. 2, backer 102 includes a width 128 and shelf unit 104 includes a width 130. Width 128 is greater than width 130 and because shelf unit 104 is centrally mounted to backer 102, the front of backer 102 is divided into exposed sections that are to the right and to the left of shelf unit 104. In these exposed sections, a plurality of peg hooks 132, 133, 134 and 135 are coupled to backer 102.

In one embodiment and as illustrated in FIGS. 1-3, a portion of the peg hooks are located between a left side edge 136 of backer 102 and left side wall 108 of shelf unit 104 and a remaining portion of the peg hooks are located between a right side edge 138 of backer 102 and right side wall 110 of shelf unit 104. More specifically, the portion of the peg hooks that are located between left side edge 136 and shelf unit 104 include two spaced apart peg hooks 132 and 133 and the remaining portion of the peg hooks that are located between right side edge 138 and shelf unit 104 include two spaced apart peg hooks 134 and 135. Furthermore, peg hook 132 is spaced apart from left side edge 136 of backer 102 on its left and spaced apart from peg hook 133 on its right. Peg hook 133 is spaced apart from peg hook 132 on its left and spaced apart from left side wall 108 of shelf unit 104 on its right. Still further, peg hook 134 is spaced apart from right side wall 110 of shelf unit 104 on its left and spaced apart from peg hook 135 on its right. Peg hook 135 is spaced apart from peg hook 134 on its left and spaced apart from right side edge 138 of backer 102 on its right.

Figure 9:
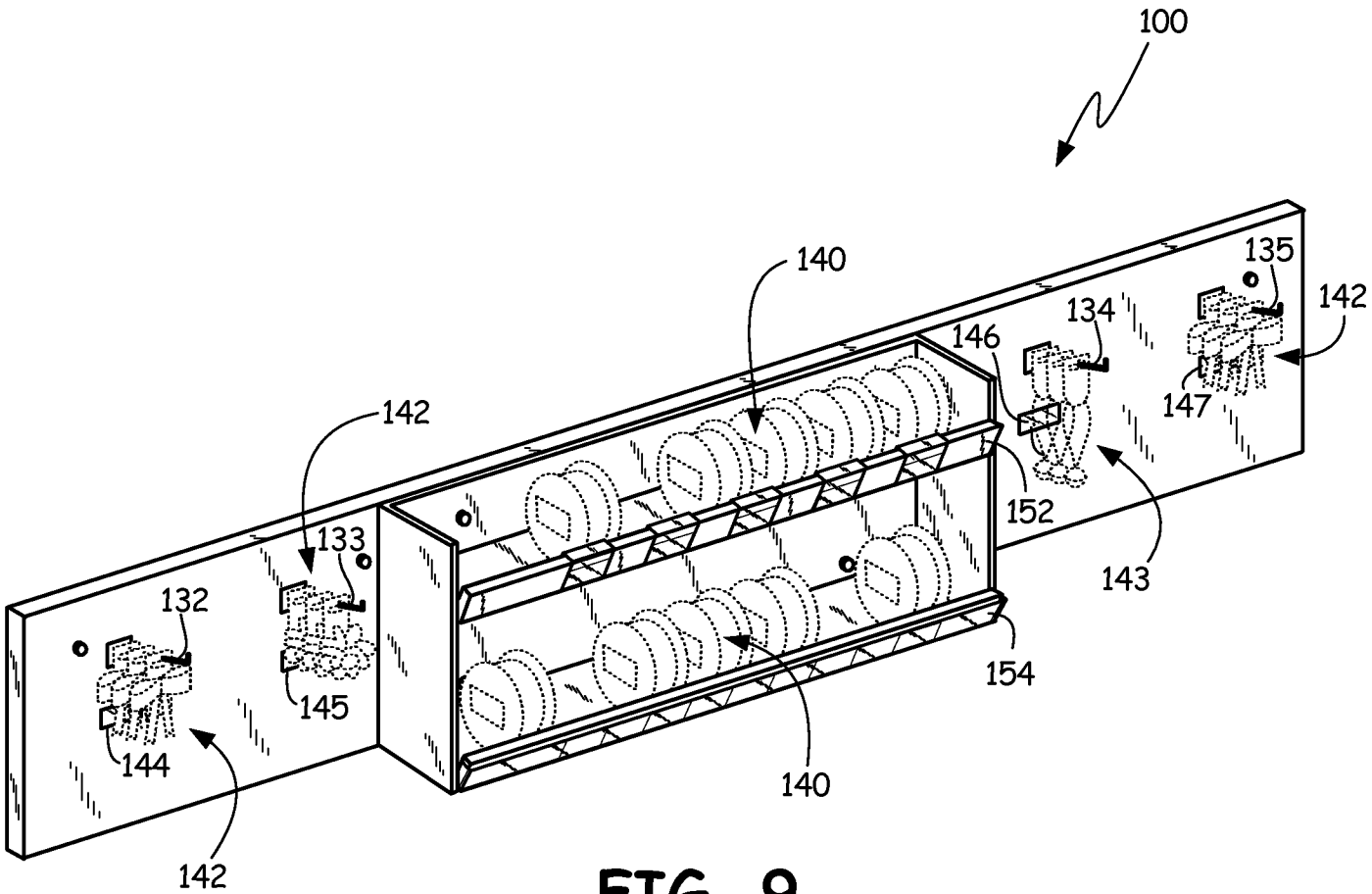
FIG. 9 is the assembled perspective view of the display fixture illustrated in FIG. 2, but stocked with ribbon rolls and bows.

FIG. 9 is the assembled perspective view of display fixture 100 as illustrated in FIG. 2, but stocked with gift decorating items (illustrated in broken lines), such as ribbon rolls 140, bows 142 and ornaments 143. With reference to FIGS. 1-3 and 6, mounted to backer 102 includes a plurality of label pockets 144, 145, 146 and 147. Under each peg hook 132, 133, 134 and 135 is located a corresponding label pocket 144, 145, 146 and 147. Each label pocket 144, 145, 146 and 147 holds a price label 148, 149, 150 and 151. Price labels 148, 149, 150 and 151 are indicative of a price of merchandise located on the corresponding peg hook 132, 133, 134 and 135.

With reference to FIGS. 1-2 and 6, each lip 120 and 122 of shelves 114 and 116 includes an outer facing surface 152 and 154. Mounted to outer facing surface 152 of lip 120 of upper shelf 114 includes a plurality of label pockets 156. Each label pocket 156 holds a price label 157. Price labels 157 are indicative of a price of merchandise located on the corresponding upper shelf 114. Mounted to outer facing surface 154 of lip 122 of lower shelf 116 includes a label strip 158. Label strip 158 holds price labels 159. Price labels 159 are indicative of prices of merchandise located on the corresponding lower shelf 116.

Figure 10:
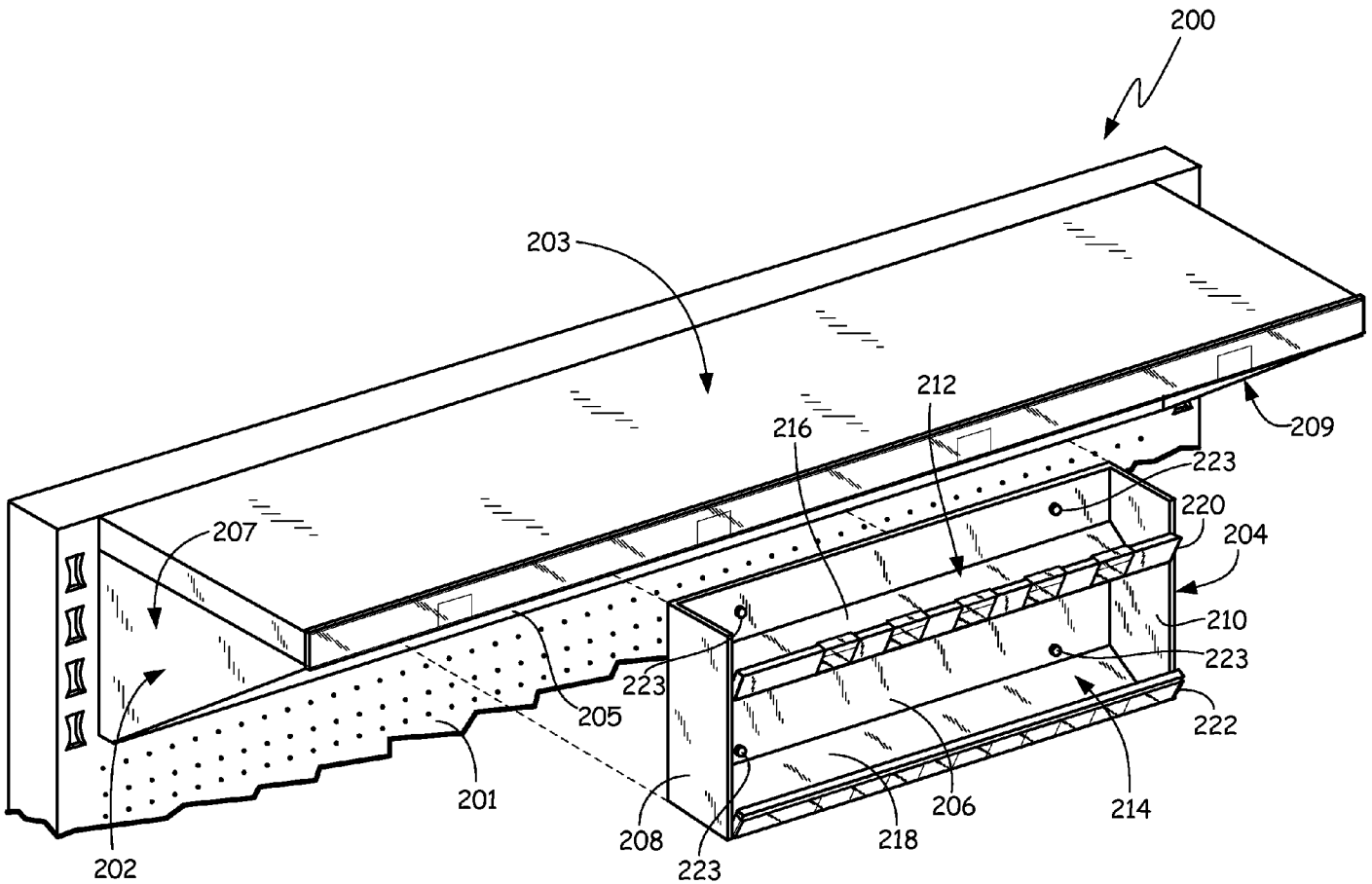
FIG. 10 is an exploded perspective view of a display fixture according to another embodiment.
Figure 11:
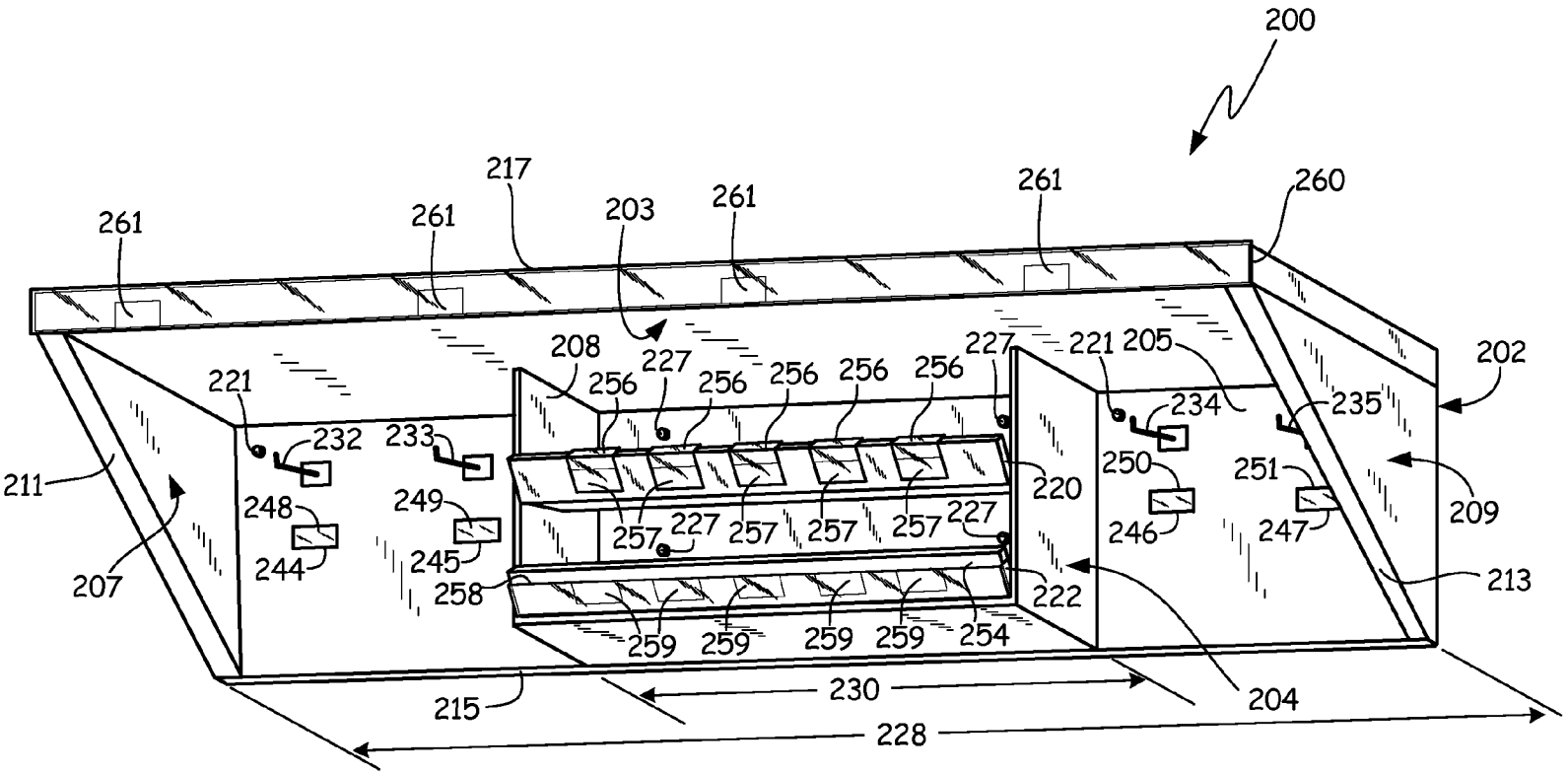
FIG. 11 is an assembled perspective view of the display fixture illustrated in FIG. 10.
Figure 12:
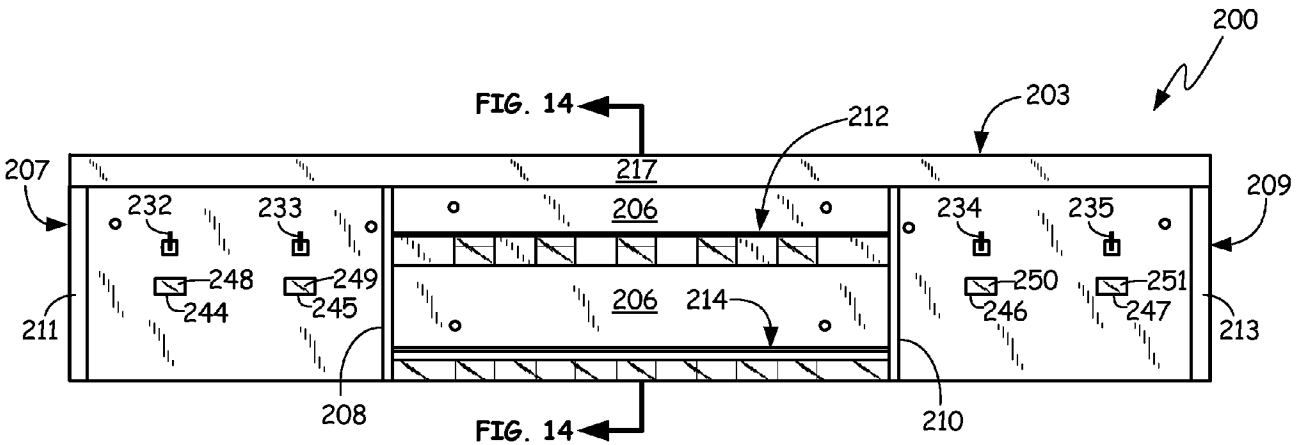
FIG. 12 is a front view of the display fixture illustrated in FIG. 11.
Figure 14:
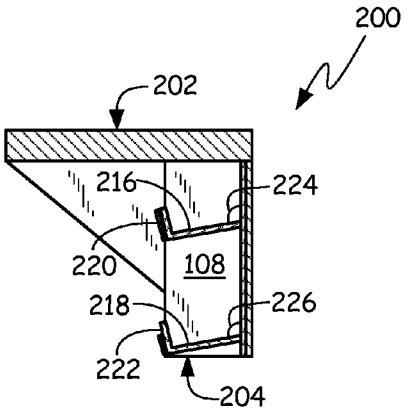
FIG. 14 is a section view of the display fixture illustrated in FIG. 11 taken along the line illustrated in FIG. 12.
Figure 13:
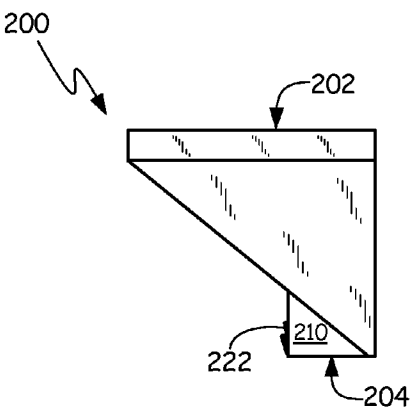
FIG. 13 is a side view of the display fixture in FIG. 11, the opposite side being a minor image.
Figure 15:
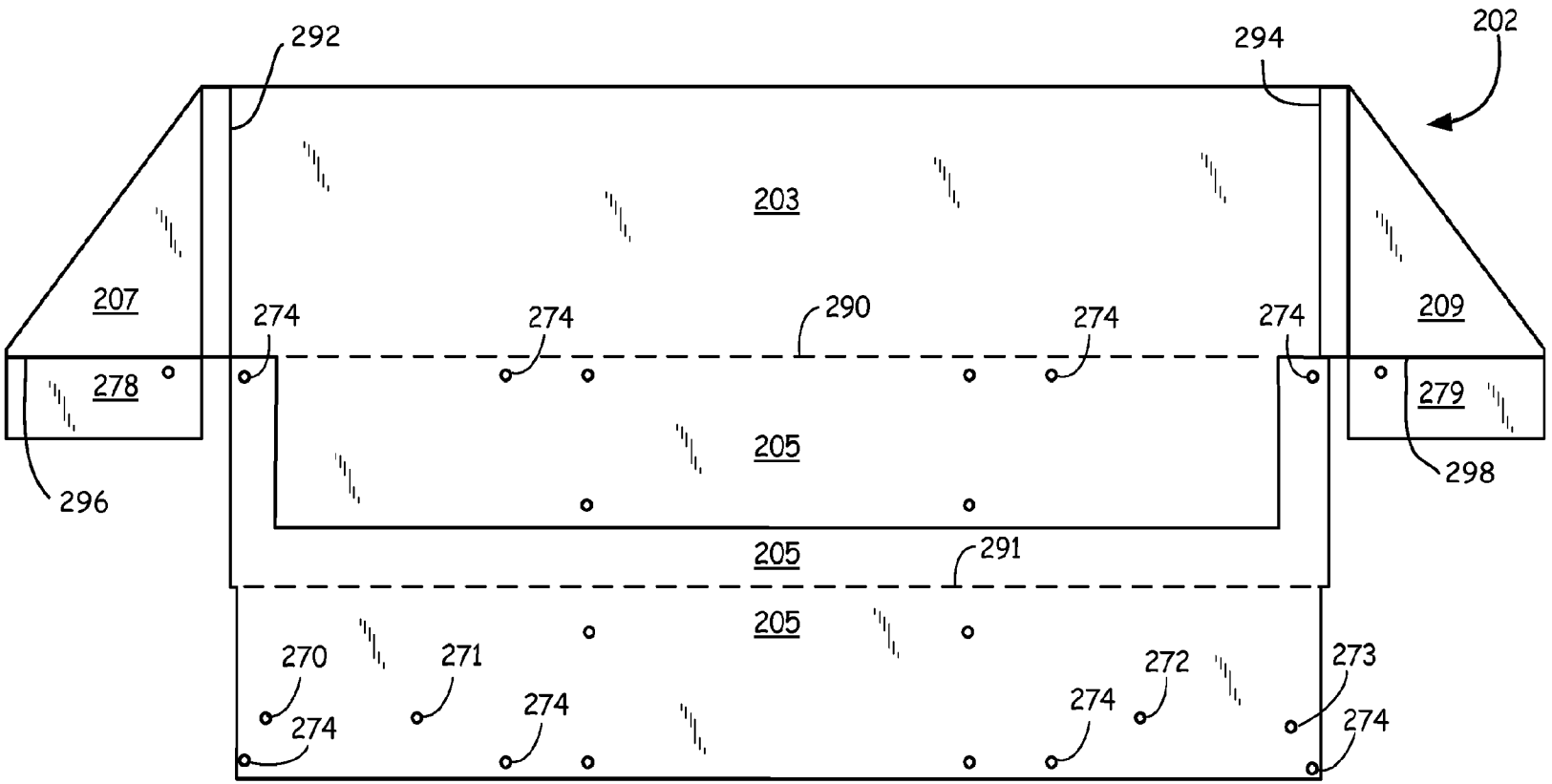
FIG. 15 is a plan view of a shelf body of the display fixture illustrated in FIG. 11 in a substantially planar configuration.
Figure 17:
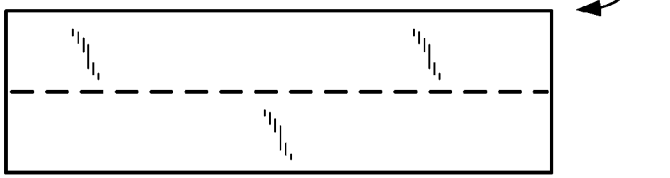
FIG. 17 is a plan view of a shelf of the shelf unit of the display fixture illustrated in FIG. 11 in a substantially planar configuration.
Figure 16:
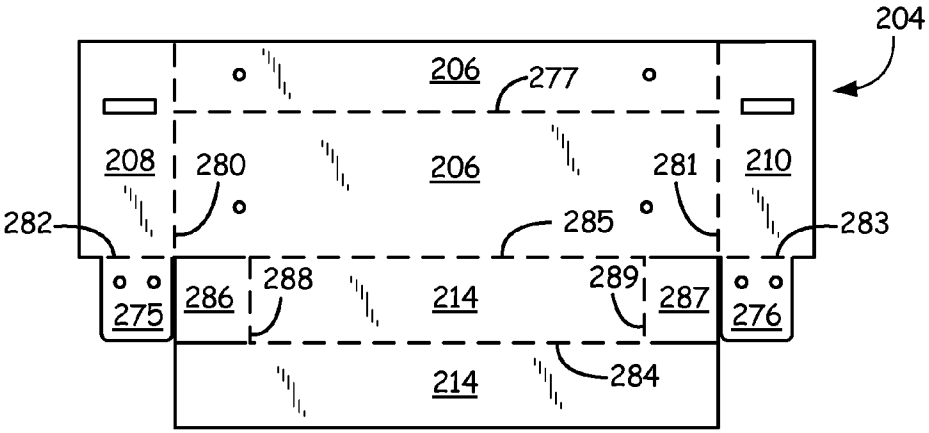
FIG. 16 is a plan view of a shelf unit of the display fixture illustrated in FIG. 11 in a substantially planar configuration.

FIG. 10 is an exploded perspective view of a display fixture 200 according to another embodiment. FIG. 11 is an assembled bottom perspective view of the display fixture 200 illustrated in FIG. 10. FIG. 12 is a front view of the display fixture 200 illustrated in FIG. 11. FIG. 13 is a side view of the display fixture 200 illustrated in FIG. 11, the opposite side being a minor image. FIG. 14 is a section view of the display fixture illustrated in FIG. 11 taken along the line indicated in FIG. 12. Each component of display fixture 200 is shipped to a retail store flat or in a substantially planar configuration and is lightweight, inexpensive, and recyclable. For example, FIG. 15 illustrates a plan view of a main shelf body 202 in a substantially planar configuration, FIG. 16 illustrates a plan view of a ribbon shelf body 204 in a substantially planar configuration and FIG. 17 illustrates a plan view of a shelf 212 in a substantially planar configuration. Main shelf body 202, ribbon shelf body 204 and shelf 212 are the three components of display fixture 200 that are shipped to a retail store flat for later assembly. In light of the substantially planar configurations, in one embodiment, display fixture 200 is a temporary display fixture that can be used during a particular shopping season and then easily deconstructed for disposal. For example, main shelf body 202, ribbon shelf body 204 and shelf 212 of display fixture 200 can be made of corrugated cardboard. In FIGS. 15-17, all solid lines represent edges while all dashed lines represent scores or folds. It should be noted that some scores or folds are hidden from view in FIG. 15 by edges of components.

In one embodiment, display fixture 200 holds gift decorating items, such as bows and ribbons, for display and includes main shelf body 202 (similar to backer 102 of display fixture 100) that is mounted to a wall of a gondola display unit 201. Further assembly is needed from the substantially planar configuration of main shelf body 202 in FIG. 15 to configure main shelf body 202 into the usable configuration illustrated in FIGS. 10-14. In particular, the substantially planar configuration of main shelf body 202 includes a top 203 (which includes an upper portion that is hidden below the illustrated lower portion), a back 205 (which includes three portions—a middle portion that couples to top 203 along a score or fold 290, a rear portion that is partially illustrated in FIG. 15 and is underneath the middle portion and a front portion that couples to the rear portion along a score or fold 291), a pair of opposing sides 207 and 209 and a pair of tabs 278 and 279.

To erect main shelf body 202, sides 207 and 209 are folded up about side fold lines 292 and 294 and tabs 278 and 279 are folded in about tab fold lines 296 and 298. Top 203 is folded along score 290 so that the upper portion and the lower portion of form a double thickness for top 203. The front portion of back 205 is pulled up and folded along score 291 and into the body. To complete the assembly, tabs 278 and 279 are locked into corresponding slots. The only further assembly main shelf body 202 needs before being mounted to a wall of gondola display unit 201 are the insertion of peg hooks 232, 233, 234 and 235 through holes 270, 271, 272 and 273. Peg hooks 232, 233, 234 and 235 will be discussed in further detail below.

Fully assembled, main shelf body 202 is mounted to the wall of gondola display unit 201 by aligning a top of main shelf body 202 with a top of a wall of gondola display unit 201 and securing main shelf body 202 to the wall of the gondola display unit 201 using fasteners 221 (FIG. 11). Fasteners 221 are inserted through apertures 274 in backer 102 and connect with holes in the wall of the gondola display unit 201.

Display fixture 200 also includes a ribbon shelf body 204 (similar to shelf unit 104 of display fixture 100) mounted to and centrally located on main shelf body 202. Further assembly is needed from the substantially planar configuration of ribbon shelf body 204 in FIG. 16 to configure ribbon shelf body 204 into the usable configuration illustrated in FIGS. 10-14. In particular, the substantially planar configuration of ribbon shelf body 204 includes a back wall portion 206 (which includes an upper portion coupled to a lower portion by score or fold 277), a pair of side wall portions 208 and 210, shelf portion 214 (which includes an upper portion coupled to a lower portion by a score or fold 284 and two shelf flaps 286 and 287 coupled to the upper portion of shelf portion 214 by scores or folds 288 and 289) and a pair of tabs 275 and 276. Back wall portion 206 is coupled to side wall portions 208 and 210 by scores or folds 280 and 281, tabs 275 and 276 are coupled to side wall portions 208 and 210 by scores or folds 282 and 283 and shelf portion 214 is coupled to back wall portion 206 by a score or fold 285.

To erect ribbon shelf body 204, shelf flaps 286 and 287 are folded up along scores 288 and 289 and side wall portions 208 and 210 are folded up. Tabs 275 and 276 are folded inwardly to align their holes with holes that are underneath shelf flaps 286 and 287. Fasteners or various piece of hardware secures tabs 275 and 276 to the bottom of shelf portion 214. This process of connecting tabs 275 and 276 to the bottom of shelf portion 214 creates a lip 222 having a double thickness of material. To complete the assembly, clips are inserted into back wall portion 206 along score or fold 277 and shelf 212, illustrated in FIG. 17, is aligned and inserted into the clips. Shelf 212 in FIG. 17 is already assembled and like shelf 214 includes a lip 220 having a double thickness of material. Fully assembled, ribbon shelf body 204 is mounted to main shelf body 202 by aligning apertures 223 (FIG. 10) in ribbon shelf body 204 with apertures (not shown) in main shelf body 202 and inserting fasteners 227 (FIG. 11) into the aligned apertures.

Main shelf body 202 includes top 203, back 205, the pair of opposing sides 207 and 209 and a main shelf body width 228. Each of the pair of opposing side panels 207 and 209 include corresponding front edges 211 and 213. Front edges 211 and 213 of side panels 207 and 209 extend from a bottom edge 215 of back panel 205 to a front edge 217 of top panel 203. Opposing side panels 207 and 209 provide top panel 203 with the requisite strength to support products that can be displayed on top of top panel 203. For example, top panel 203 can support gift decorating items, such as kits of bows, ribbons and ornaments. In this way, top panel 203 is a shelf that is supported by the pair of side panels 207 and 209 and is cantilevered over ribbon shelf body 204.

Ribbon shelf body 204 includes back wall 206 that is oriented substantially vertically, the pair of side walls 208 and 210 and the plurality of shelves 212 and 214. Ribbon shelf body 204 is configured to hold and display ribbon rolls, while back panel 205 of main shelf body 202 is configured to not only receive ribbon shelf body 204, but also receive peg hooks for displaying other types of gift decorating items, such as bows, on either side of ribbon shelf body 204. Other types of merchandise can be displayed by display fixture 200. Such merchandise includes products that can be hung from peg hooks or retained on shelves, such as large or small shelves, for display.

The plurality of shelves 212 and 214 of ribbon shelf body 204 extend between the pair of side walls 208 and 210 and are coupled to back wall 206. Each shelf 212 and 214 includes a shelf surface 216 and 218 and a lip 220 and 222. Lip 220 of shelf 212 that is oriented substantially normally to shelf surface 216 and lip 222 of shelf 214 that is oriented substantially normally to shelf surface 218. Shelf surfaces 216 and 218, however, are oriented at an angle 224 and 226 relative to back wall 206, and angles 224 and 226 are substantially the same. In one embodiment, the relative angles 224 and 226 between shelf surfaces 216 and 218 and back wall 206 are greater than 90 degrees. In particular, the relative angles 224 and 226 are approximately 100 degrees. In this way, shelf surfaces 216 and 218 are oriented towards the shopper for display and each lip 220 and 222 retains the merchandise located on shelves 212 and 216 in place.

As illustrated in FIG. 11, main shelf body 202 includes a width 228 and ribbon shelf body 204 includes a width 230. Width 228 is greater than width 230 and because ribbon shelf body 204 is centrally mounted to back panel 205 of main shelf body 202, the front of back panel 205 is divided into exposed sections that are to the right and to the left of ribbon shelf body 204. In these exposed sections, a plurality of peg hooks 232, 233, 234 and 235 are coupled to back panel 205 of main shelf body 202.

In one embodiment and as illustrated in FIGS. 10-12, a portion of the peg hooks are located between left side panel 207 of main shelf body 202 and left side wall 208 of ribbon shelf body 204 and a remaining portion of the peg hooks are located between a right side panel 209 of main shelf body 202 and right side wall 210 of ribbon shelf body 204. More specifically, the portion of the peg hooks located between left side panel 207 and ribbon shelf body 204 include two spaced apart peg hooks 232 and 233 and the remaining portion of the peg hooks located between right side panel 209 and ribbon shelf body 204 include two spaced apart peg hooks 234 and 235. Furthermore, peg hook 232 is spaced apart from left side panel 207 of main shelf body 202 on its left and spaced apart from peg hook 233 on its right. Peg hook 233 is spaced apart from peg hook 232 on its left and spaced apart from left side wall 208 of ribbon shelf body 204 on its right. Still further, peg hook 234 is spaced apart from right side wall 210 of ribbon shelf body 204 on its left and spaced apart from peg hook 235 on its right. Peg hook 235 is spaced apart from peg hook 234 on its left and spaced apart from right side panel 209 of main shelf body 202 on its right.

Figure 18:
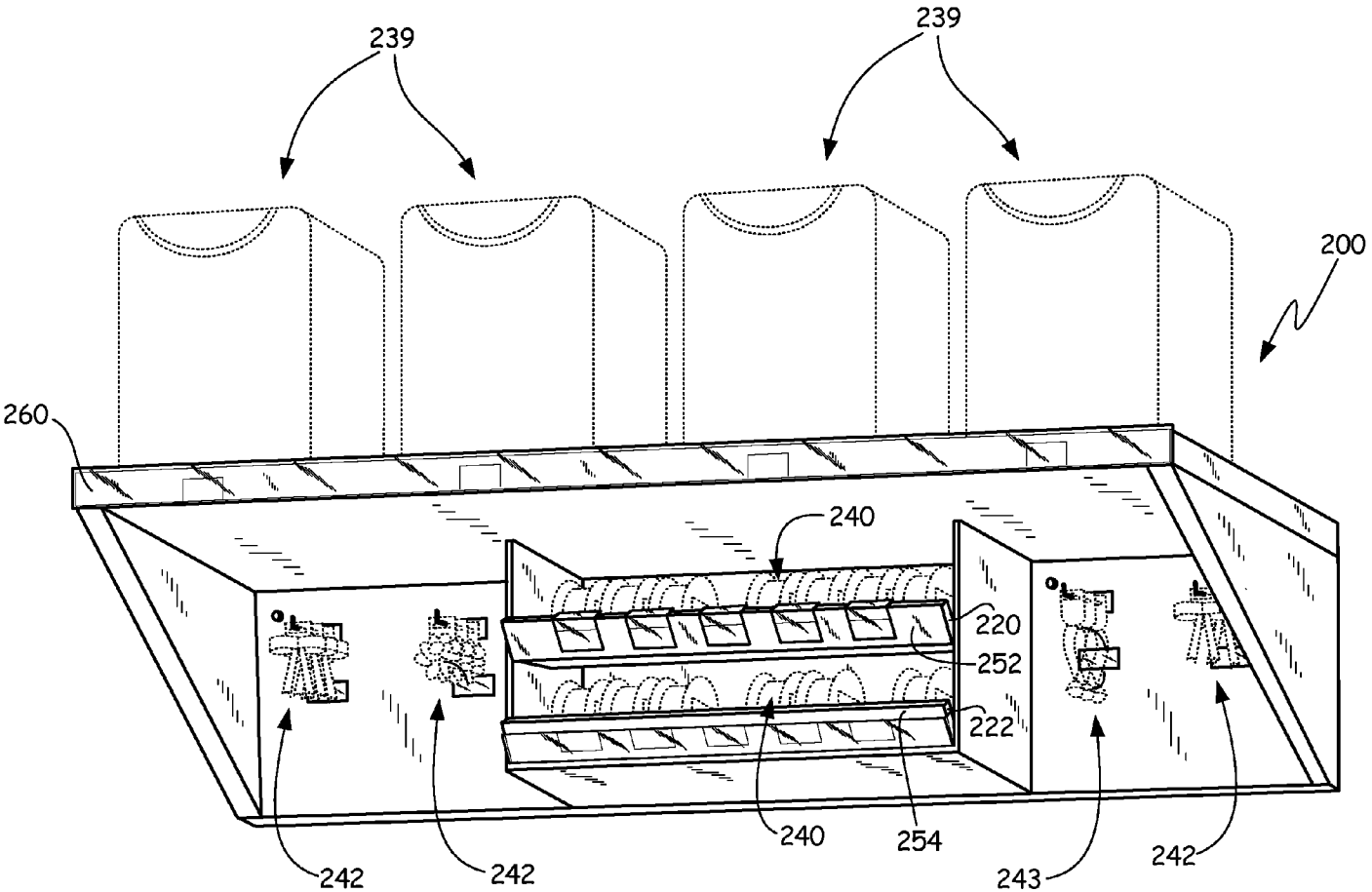
FIG. 18 is the assembled perspective view illustrated in FIG. 11, but stocked with ribbon rolls and bows.

FIG. 18 is the assembled perspective view of display fixture 200 as illustrated in FIG. 11, but stocked with gift decorating items (illustrated in broken lines), such as ribbon rolls 240, bows 242, ornaments 243 and kits 239 of bows, ribbons and ornaments. With reference to FIGS. 10-12 and 18, mounted to back panel 205 of main shelf body 202 includes a plurality of label pockets 244, 245, 246 and 247. Under each peg hook 232, 233, 234 and 235 is located a corresponding label pocket 244, 245, 246 and 247. Each label pocket 244, 245, 246 and 247 holds a price label 248, 249, 250 and 251. Price labels 248, 249, 250 and 251 are indicative of a price of merchandise located on the corresponding peg hook 232, 233, 234 and 235.

With reference to FIGS. 11 and 18, each lip 220 and 222 of shelves 214 and 216 includes an outer facing surface 252 and 254. Mounted to outer facing surface 252 of lip 220 of upper shelf 212 includes a plurality of label pockets 256. Each label pocket 256 holds a price label 257. Price labels 257 are indicative of prices of merchandise located on the corresponding upper shelf 212.

With reference to FIGS. 11 and 18, mounted to outer facing surface 254 of lip 222 of lower shelf 214 includes a label strip 258. Label strip 258 holds price labels 259. Price labels 259 are indicative of a price of merchandise located on the corresponding lower shelf 214.

With reference to FIGS. 11 and 18, mounted to front edge 217 of top panel 203 of main shelf body 202 includes a label strip 260. Label strip 260 holds price labels 261. Price labels 261 are indicative of prices of merchandise located on the corresponding top panel or cantilevered shelf 203.

With reference to FIGS. 1-5 and 9, a method of displaying merchandise includes mounting backer 102 to a wall 101 of a gondola and mounting and centrally locating shelf unit 104 on the backer 102. Further, the method includes mounting a plurality of peg hooks 132, 133, 134 and 135 to backer 102. More specifically and in one embodiment, a portion of the plurality of peg hooks are mounted between a left side edge 136 of backer 102 and the centrally located shelf unit 104 and a remaining portion of the plurality of peg hooks are mounted between a right side edge 138 of backer 102 and the centrally located shelf unit 104.

In further embodiments, the method can include mounting a plurality of label pockets 144, 145, 146 and 147 that hold price labels 148, 149, 150 and 151 to backer 102 below each peg hook 132, 133, 134 and 135, mounting a plurality of label pockets 156 that hold price labels 157 to outer facing surface 152 of lip 120 of upper shelf 112 of centrally located shelf unit 104 and mounting a label strip 158 that holds price labels 159 to outer facing surface 154 of lip 122 of lower shelf 114 of centrally located shelf unit 104.

In another embodiment, wherein mounting the substantially vertical backer to the wall of a gondola can alternatively include mounting a main shelf body 202 including a top panel or top shelf 203, a back panel 205 and a pair of opposing side panels 207 and 209 and a main shelf body width 228 to the wall 201 of a gondola as illustrated in FIG. 10. In further embodiments, the method can include mounting a label strip 260 that holds price labels 261 to front edge 217 of top panel or top shelf 203.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a backer having a substantially vertical back panel formed separately from and adapted to be mounted to a wall of a gondola; and a shelf unit mounted to the substantially vertical back panel of the backer and being centrally located on the substantially vertical back panel of the backer, the shelf unit including a substantially vertical back wall, a pair of side walls and a plurality of shelves extending between the pair of side walls and coupled to the back wall, wherein the substantially vertical back wall is positioned to abut and be entirely positioned on a front surface of the substantially vertical back panel of the backer, each of the plurality of shelves includes a shelf surface and a lip, the lip is substantially normal to the shelf surface, the shelf surface is at an angle relative to the back wall, and the relative angle between the shelf surface and the back wall is greater than 90 degrees;

wherein the backer further comprises a pair of side panels and a top shelf, wherein the front edges of the pair of side panels of the backer extend from a bottom edge of the substantially vertical back panel to a front edge of the top shelf, and the front edge of the top shelf is positioned opposite to and faces away from the substantially vertical back panel of the backer.

2. The display fixture of claim 1, further comprising a plurality of peg hooks coupled to the backer, wherein a portion of the plurality of peg hooks is located between a left side edge of the substantially vertical back panel of the backer and the centrally located shelf unit and a remaining portion of the plurality of peg hooks is located between a right side edge of the substantially vertical back panel of the backer and the centrally located shelf unit.

3. The display fixture of claim 2, wherein the portion of the plurality of peg hooks located between the left side edge of the substantially vertical back panel of the backer and the centrally located shelf unit comprises two peg hooks spaced apart from each other and wherein the remaining portion of the plurality of peg hooks located between the right side edge of the substantially vertical back panel of the backer and the centrally located shelf unit comprises two peg hooks spaced apart from each other.

4. The display fixture of claim 2, further comprising a plurality of label pockets that hold price labels, wherein below each peg hook is one of the plurality of label pockets, the price labels being indicative of a price of merchandise located on the peg hooks.

5. The display fixture of claim 4, wherein each lip of each shelf comprises an outer facing surface, wherein mounted to the outer facing surface of the lip of an upper shelf of the plurality of shelves comprises some of the plurality of label pockets, the price labels in the label pockets that are included on the outer facing surface of the lip of the upper shelf are indicative of prices of merchandise located on the upper shelf.

6. The display fixture of claim 1, wherein each lip of each shelf comprises an outer facing surface, wherein mounted to the outer facing surface of the lip of a lower shelf of the plurality of shelves comprises a label strip for holding price labels, the price labels being indicative of prices of merchandise located on the lower shelf.

7. The display fixture of claim 1, wherein mounted to the front edge of the top shelf includes a label strip for holding price labels, the price labels in the label strip being indicative of prices of merchandise located on the top shelf.

8. The display fixture of claim 1, wherein the backer is formed substantially entirely of corrugated cardboard, and the shelf unit is formed substantially entirely of corrugated cardboard.

9. The display fixture of claim 1, wherein the substantially vertical back panel is formed of two layers.

10. The display fixture of claim 9, wherein a different tab extends from each of the side panels, and the different tab is interposed between the two layers to couple the side panel to the substantially vertical back panel along a side edge of the substantially vertical back panel.

11. The display fixture of claim 1, wherein the pair of side walls of the shelf unit are inset from the pair of side panels of the backer such that side portions of the substantially vertical back panel of the backer are exposed on either side of the shelf unit such that merchandise can be displayed over the substantially vertical back panel between the each of the pair of side walls of the shelf unit and a corresponding one of the pair of side panels.

12. A display fixture comprising:

a main shelf body including a top panel, a back panel, a pair of opposing side panels and a main shelf body width, wherein front edges of the pair of opposing side panels extend from a bottom edge of the back panel to a front edge of the top panel; and a ribbon shelf body centrally mounted to the back panel of the main shelf body, the ribbon shelf body including a substantially vertical back wall, a pair of side walls, a plurality of shelves extending between the pair of side walls and coupled to the back wall and a ribbon shelf body width, each of the plurality of shelves including a shelf surface and a lip;

wherein the main shelf body width is greater than the ribbon shelf body width, and the main shelf body is a single planar corrugated member bent about fold lines therein to define each of the top panel, the back panel, and the pair of opposing side panels.

13. The display fixture of claim 12, wherein the lip of each of the plurality of shelves of the ribbon shelf body is substantially normal to the shelf surface of each of the plurality of shelves of the ribbon shelf body.

14. The display fixture of claim 13, wherein the shelf surface of each of the plurality of shelves of the ribbon shelf body is at an angle relative to the back wall of the ribbon shelf body and the relative angle between each shelf surface and the back wall of the ribbon shelf body is greater than 90 degrees.

15. The display fixture of claim 12, further comprising a plurality of peg hooks coupled to the back panel of the main shelf body, wherein a portion of the plurality of peg hooks is located between one of the side panels of the main shelf body and the centrally mounted ribbon shelf body and a remaining portion of the plurality of peg hooks is located between the other of the side panels of the main shelf body and the centrally mounted ribbon shelf body.

16. The display fixture of claim 15, wherein the portion of the plurality of peg hooks located between the one side panel of the of the main shelf body and the centrally mounted ribbon shelf body comprises two peg hooks spaced apart from each other and wherein the remaining portion of the plurality of pegs hooks located between the other side panel of the main shelf body and the centrally mounted ribbon shelf body comprises two peg hooks spaced apart from each other.

17. The display fixture of claim 12, wherein the top panel of the main shelf body comprises a shelf that is supported by the pair of side panels and is cantilevered over the ribbon shelf body.

18. The display fixture of claim 12, wherein the opposing side panels are each coupled to a different end of the top panel via a different side fold line, the main shelf body further includes a pair of tabs, each of the pair of tabs is coupled to a different side panel of the pair of opposing side panels along a different tab fold line, is folded about the corresponding different tab fold line, and is secured to a rear surface of the back panel such that that each of the different side panels of the pair of opposing side panels extends from the top panel to the back panel.

19. A method of displaying merchandise comprising:

mounting a substantially vertical panel of a backer over and to a substantially vertical wall of a gondola;

mounting and centrally locating a shelf unit on the substantially vertical panel of the backer, the shelf unit including a substantially vertical back wall abutting the substantially vertical panel of the backer, a pair of side walls and a plurality of shelves extending between the pair of side walls and coupled to the back wall, wherein each of the plurality of shelves includes a shelf surface and a lip, the lip is substantially normal to the shelf surface, the shelf surface is at an angle relative to the back wall, the relative angle between the shelf surface and the back wall being greater than 90 degrees, and mounting and centrally locating the shelf unit on the substantially vertical panel of the backer includes folding a single planar piece of material to form the substantially vertical back wall and the pair of side walls extending forwardly from the substantially vertical back wall; and mounting a plurality of peg hooks to the substantially vertical panel of the backer, wherein a portion of the plurality of peg hooks is mounted between a left side edge of the backer and the centrally located shelf unit and a remaining portion of the plurality of peg hooks is mounted between a right side edge of the backer and the centrally located shelf unit, wherein the peg hooks receive bows for display and the shelf unit receives ribbon rolls for display.

20. The method of claim 19, further comprising mounting a plurality of label pockets that hold price labels to the backer, wherein each label pocket is located below each peg hook and the price labels being indicative of prices of merchandise located on the peg hooks.

21. The method of claim 19, further comprising mounting a plurality of label pockets to an outer facing surface of the lip of an upper shelf of the centrally located shelf unit, each label pocket configured to hold a price label indicative of a price of merchandise located on the upper shelf.

22. The method of claim 19, wherein mounting the substantially vertical backer to the wall of a gondola further comprises mounting a main shelf body including a top shelf, a back panel and a pair of opposing side panels to the wall of the gondola, wherein front edges of the pair of opposing side panels extend from a bottom edge of the back panel to a front edge of the top shelf.

23. The method of claim 19, wherein mounting the substantially vertical backer to the wall of the gondola includes placing the substantially vertical backer over and directly adjacent to a portion of the wall of the gondola and inserting fasteners through apertures in the substantially vertical backer and through corresponding holes in the wall of the gondola.

24. The method of claim 19, wherein folding a single planar piece of material includes creating a shelf lip having a double thickness of material near a front of the one shelf.

* * * * *